US009573026B2

(12) United States Patent
DeCarlo, Jr.

(10) Patent No.: US 9,573,026 B2
(45) Date of Patent: Feb. 21, 2017

(54) GOLF PUTTER

(71) Applicant: James T. DeCarlo, Jr., New Canaan, CT (US)

(72) Inventor: James T. DeCarlo, Jr., New Canaan, CT (US)

( * ) Notice: Subject to any disclaimer, the term of this patent is extended or adjusted under 35 U.S.C. 154(b) by 0 days.

(21) Appl. No.: 14/640,208

(22) Filed: Mar. 6, 2015

(65) Prior Publication Data

US 2015/0258391 A1 Sep. 17, 2015

Related U.S. Application Data

(60) Provisional application No. 61/951,619, filed on Mar. 12, 2014.

(51) Int. Cl.

| | |
|---|---|
| ***A63B 53/02*** | (2015.01) |
| ***A63B 53/00*** | (2015.01) |
| ***A63B 53/10*** | (2015.01) |
| *A63B 53/04* | (2015.01) |

(52) U.S. Cl.

CPC ..... *A63B 53/02* (2013.01); *A63B 53/007* (2013.01); *A63B 53/10* (2013.01); *A63B 53/0487* (2013.01)

(58) Field of Classification Search

CPC ... A63B 53/02; A63B 53/007; A63B 53/0487; A63B 53/10; A63B 53/12

See application file for complete search history.

(56) References Cited

U.S. PATENT DOCUMENTS

| | | | | |
|---|---|---|---|---|
| 2,478,468 A * | 8/1949 | Drake | A63B 53/0487 | 473/313 |
| 3,085,804 A * | 4/1963 | Pieper | A63B 53/0487 | 473/325 |
| 3,305,235 A * | 2/1967 | Williams, Jr. | A63B 53/06 | 403/371 |
| 3,519,271 A * | 7/1970 | Smith | A63B 53/02 | 473/305 |

(Continued)

FOREIGN PATENT DOCUMENTS

| | | | |
|---|---|---|---|
| CA | 2521955 * | 1/2016 | |
| GB | 2278063 A * | 11/1994 | A63B 53/0487 |

(Continued)

OTHER PUBLICATIONS

PCT International Search Report and Written Opinion of the International Searching Authority issued on corresponding International Application No. PCT/US2015/019184.

*Primary Examiner* — Stephen Blau
(74) *Attorney, Agent, or Firm* — Locke Lord LLP; Alicia J. Carroll; Joshua L. Jones

(57) ABSTRACT

A golf putter includes a club shaft and a club head. The club shaft includes a club shaft body extending from a proximal end to a distal end. The club shaft body has a first linear portion defining a longitudinal axis. The distal end defines a tangent angled with respect to the longitudinal axis. The club shaft body also includes a curved portion between the first linear portion and the distal end. The club head includes a ball striking surface, a heel proximate to a first end of the ball striking surface, and a toe opposing the heel proximate to a second end of the ball striking surface. A club head axis is defined between the toe and the heel. The distal end of the club shaft body is connected to the club head at a connection point on the heel.

11 Claims, 2 Drawing Sheets

(56) References Cited

U.S. PATENT DOCUMENTS

| | | | | |
|---|---|---|---|---|
| D242,730 | S | 12/1976 | Pappas | |
| 5,267,733 | A | 12/1993 | Szokola | |
| 5,292,123 | A * | 3/1994 | Schmidt, Jr. | A63B 53/02 473/248 |
| 5,433,441 | A * | 7/1995 | Olsen | A63B 53/0487 473/328 |
| 5,586,392 | A * | 12/1996 | Pasquale | A01B 1/08 30/309 |
| 5,643,100 | A | 7/1997 | Zabytko et al. | |
| 5,746,665 | A | 5/1998 | Wenker | |
| 5,755,625 | A | 5/1998 | Jackson | |
| 5,772,526 | A * | 6/1998 | Hano | A63B 53/04 473/314 |
| 5,803,824 | A | 9/1998 | Rollingson | |
| 5,816,931 | A | 10/1998 | Schooler | |
| 5,816,935 | A | 10/1998 | Se-Hyup | |
| 5,931,741 | A | 8/1999 | Fenton, Jr. | |
| 6,015,355 | A | 1/2000 | Angel | |
| 6,033,319 | A | 3/2000 | Farrar | |
| 6,066,053 | A * | 5/2000 | Sehemberger | A63B 53/0487 473/230 |
| 6,171,203 | B1 | 1/2001 | Huang | |
| 6,234,915 | B1 | 5/2001 | Wu | |
| 6,319,146 | B1 | 11/2001 | Mills | |
| 6,497,626 | B1 * | 12/2002 | Sundberg | A63B 53/007 473/248 |
| 6,663,499 | B2 * | 12/2003 | Riseley | A63B 53/007 313/314 |
| 6,773,362 | B1 * | 8/2004 | Choi | A63B 53/007 473/340 |
| 7,976,400 | B1 | 7/2011 | Pottorff | |
| 9,101,805 | B2 * | 8/2015 | Stites | A63B 53/02 |
| 2002/0019264 | A1 | 2/2002 | Buchanan | |
| 2003/0220149 | A1 | 11/2003 | Mills | |
| 2004/0259654 | A1 * | 12/2004 | Failla | A63B 53/007 473/230 |
| 2005/0130758 | A1 | 6/2005 | Riseley | |
| 2005/0255937 | A1 * | 11/2005 | Stackpole | A63B 53/0487 473/330 |
| 2007/0135227 | A1 | 6/2007 | Desmarais et al. | |
| 2010/0255928 | A1 | 10/2010 | Sahoda | |
| 2012/0302365 | A1 | 11/2012 | Gentes | |

FOREIGN PATENT DOCUMENTS

| | | | |
|---|---|---|---|
| JP | 2597343 | B2 | 4/1997 |
| KR | 10-1027652 | B1 | 4/2011 |

* cited by examiner

GOLF PUTTER

CROSS-REFERENCE TO RELATED APPLICATIONS

This application claims priority to U.S. Provisional Patent Application No. 61/951,619 filed Mar. 12, 2014, which is incorporated by reference herein in its entirety.

BACKGROUND OF THE INVENTION

1. Field of the Invention

The present invention relates to golf clubs and more particularly to putters.

2. Description of Related Art

A variety of golf putters are known in the art. Generally, golf putters have relatively short shafts, commonly between 18-37 inches. The shaft is generally straight and affixed toward a heel or a center of a putter club head through a hosel, such that, in use, a golfer's head is in vertical alignment over a golf ball and/or over the center of mass of the club head, commonly known as the "sweet spot". This configuration commonly places a longitudinal axis of the putter shaft and the putter club head in close proximity with one another such that the longitudinal axis of the putter shaft intersects the putter club head. In addition, putters are also known to have an offset hosel, which places the longitudinal axis of the putter shaft and the gripping portion in vertical alignment with the center of the ball at impact such that the longitudinal axis of the putter shaft intersects the ball at impact.

Such conventional methods and systems have generally been considered satisfactory for their intended purpose. However, there is still a need in the art for methods and apparatuses that allow for improved accuracy in putting. The present invention provides a solution for these problems.

SUMMARY OF THE INVENTION

A club shaft for a putter includes a club shaft body extending from a proximal end to a distal end. The club shaft body has a first linear portion defining a longitudinal axis and a curved portion. The distal end defines a tangent to the curved portion. The tangent is angled with respect to the longitudinal axis. The club shaft body also includes a curved portion between the first linear portion and the distal end.

In accordance with certain embodiments, a distance between the distal end to a point defined at the intersection of the tangent of the distal end and the longitudinal axis can range from 1 inch to 5 inches. A distance between the distal end to a point defined at the intersection of the tangent of the distal end and a line normal to the tangent extending from the proximal end can range from 8 inches to 18 inches.

It is further contemplated that an angle between the tangent of the distal end and the longitudinal axis can range from 90 degrees to 160 degrees, e.g. ranging from 115 to 135 degrees. The club shaft body can include a second linear portion proximate the distal end. The second linear portion can be angled parallel to a club head axis at a connection point between the distal end of the club shaft body and a heel of a putter. The second linear portion can also be at an angle with respect to the longitudinal axis. The angle between the second linear portion and the longitudinal axis can range from 90 degrees to 160 degrees, e.g. ranging from 115 to 135 degrees. The distal end of the club shaft body can be configured for insertion into a receptacle proximate to a connection point on a heel of a putter.

A golf putter includes a club shaft as described above and a club head. The club head includes a ball striking surface, a heel proximate to a first end of the ball striking surface, and a toe opposing the heel proximate to a second end of the ball striking surface. A club head axis is defined between the toe and the heel. The distal end of the club shaft body is connected to the club head at a connection point on the heel.

In accordance with certain embodiments, the tangent of the distal end can be parallel to the club head axis. A distance between the distal end to a point defined at the intersection of the club head axis and a line normal to the club head axis extending from the proximal end can range from 8 inches to 18 inches. The club head can include a bottom surface defined between the toe and the heel. At least a portion of the bottom surface can be configured to be parallel to a ground surface. The club head can include a receptacle proximate to the connection point for receiving the distal end of the club shaft body.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
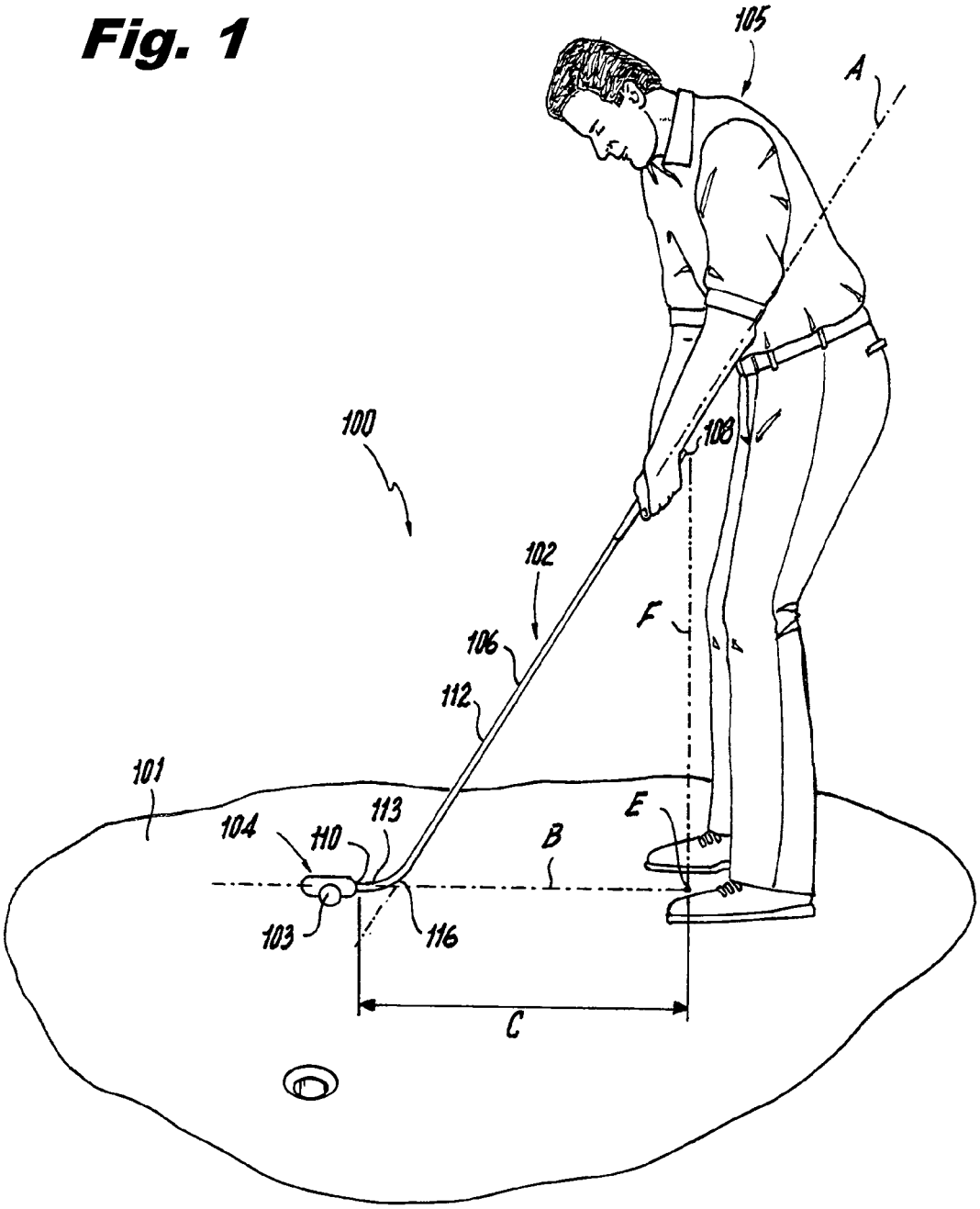
FIG. 1 is a front elevation view of an exemplary embodiment of a golf putter constructed in accordance with the present invention, showing a golfer using the putter and the distance between the hands of the golfer and the heel of the club head.

Reference will now be made to the drawings wherein like reference numerals identify similar structural features or aspects of the subject invention. For purposes of explanation and illustration, and not limitation, a partial view of an exemplary embodiment of the golf putter in accordance with the invention is shown in FIG. 1 and is designated generally by reference character 100. Other embodiments of the device in accordance with the invention, or aspects thereof, are provided in FIGS. 2-3 as will be described.

As shown in FIG. 1, a golf putter 100 includes a club shaft 102 and a club head 104. Club shaft 102 includes a club shaft body 106 extending from a proximal end 108 to a distal end 110. Club shaft body 106 has a first linear portion 112 defining a longitudinal axis A. Club shaft body 106 also includes a curved portion 116 between first linear portion 112 and distal end 110. Those skilled in the art will readily appreciate that curved portion 116 tends to increase the distance between a golfer 105 and the club head 104, as will be discussed below. Club shaft body 106 includes a second linear portion 113 proximate distal end 110. While shown and described herein as having a blade head, those skilled in the art will readily appreciate that club head 104 can be a mallet shaped club head, or any other suitable club head shape for a given application.

Figure 2:
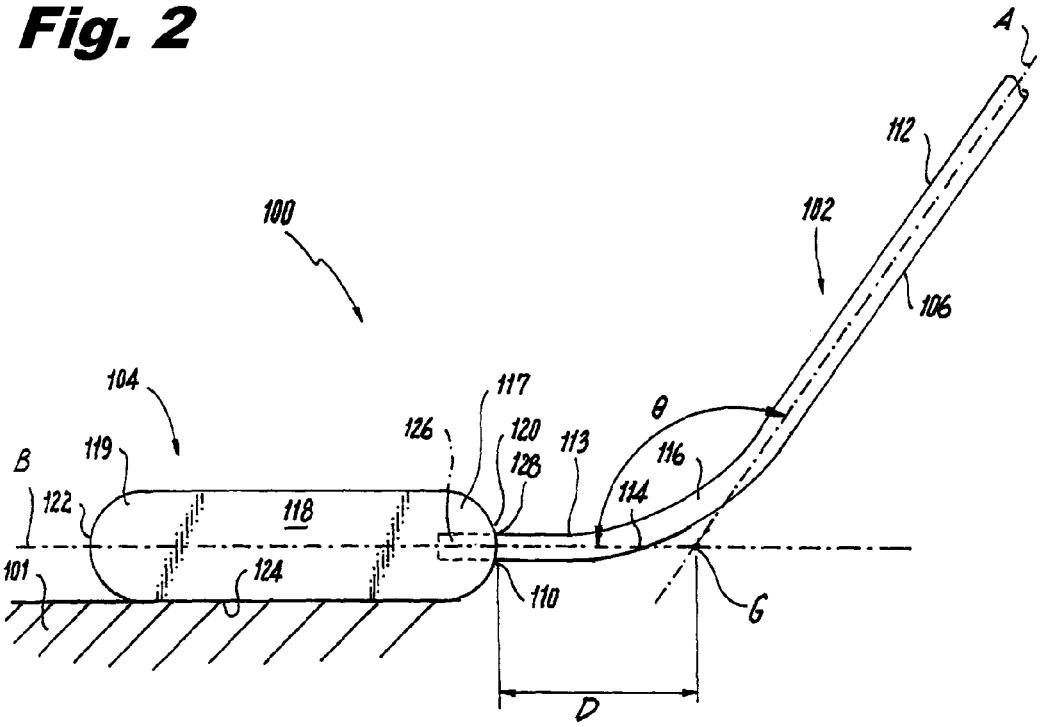
FIG. 2 is an enlarged front view of a distal end of the golf putter of FIG. 1, showing the angle between the second linear portion of the shaft body and the first linear portion of the shaft body and the curved portion between the linear portions.

Now with reference to FIG. 2, distal end 110 defines a tangent 114 to curved portion 116. Tangent 114 is angled with respect to longitudinal axis A. Club head 104 includes a ball striking surface 118, a heel 120 proximate to a first end 117 of ball striking surface 118, and a toe 122 opposing heel 120 proximate to a second end 119 of ball striking surface 118. Club head 104 includes a bottom surface 124 defined between toe 122 and heel 120. At least a portion of bottom surface 124 is configured to be parallel to a ground surface 101 in a rest position. A club head axis B is defined between toe 122 and heel 120. While club head axis B is shown in FIG. 2 as being coaxial with tangent 114, those skilled in the art will readily appreciate that club head axis B can vary depending on the shape of club head 104. Distal end 110 of club shaft body 106 is connected to club head 104 at a connection point 128 on heel 120. Second linear portion 113 is angled parallel to club head axis B at connection point 128 between distal end 110 of club shaft body 106 heel 120 of club head 104. Second linear portion 113 is co-axial with tangent 114. Club head 104 includes a receptacle 126 proximate to connection point 128 for receiving distal end 110 of club shaft body 106.

As shown in FIGS. 1 and 2, a distance C between distal end 110 to a point E defined at the intersection of club head axis B and a line F normal to club head axis B extending from proximal end 108 is greater than 8 inches. Golf putter 100 can be configured to have a distance C range from 8 to 18 inches. Distance C can have an exemplary range from 12 to 16 inches. As a specific example, distance C can be 14 inches. Those skilled in the art will readily appreciate that distance C can be similar to a distance between distal end 110 to a point defined at the intersection of tangent 114 of distal end 110 and a line normal to tangent 114 extending from proximal end 108. Distance C, in either case, substantially equates to a lateral distance between proximal end 108, near the hands of golfer 105, and distal end 110, near heel 120 of the club head. Those skilled in the art will readily appreciate that distance C allows an improved range of vision of the putting line, as well as, improved vision of the contours of the putting surface. Those skilled in the art will also readily appreciate that a distance D between distal end 110 to a point G defined at the intersection of tangent 114 of distal end 110 and longitudinal axis A can be greater than 1 inch. Golf putter 100 can be configured to have distance D range from 1 to 5 inches. Distance D can have an exemplary range of 2 to 4 inches. As specific examples, distance D can be 1.25 inches, 1.5 inches or 3 inches. Those skilled in the art will readily appreciate that distance D can be similar to a distance between distal end 110 to a point defined at the intersection of club head axis B and longitudinal axis A.

Figure 3:
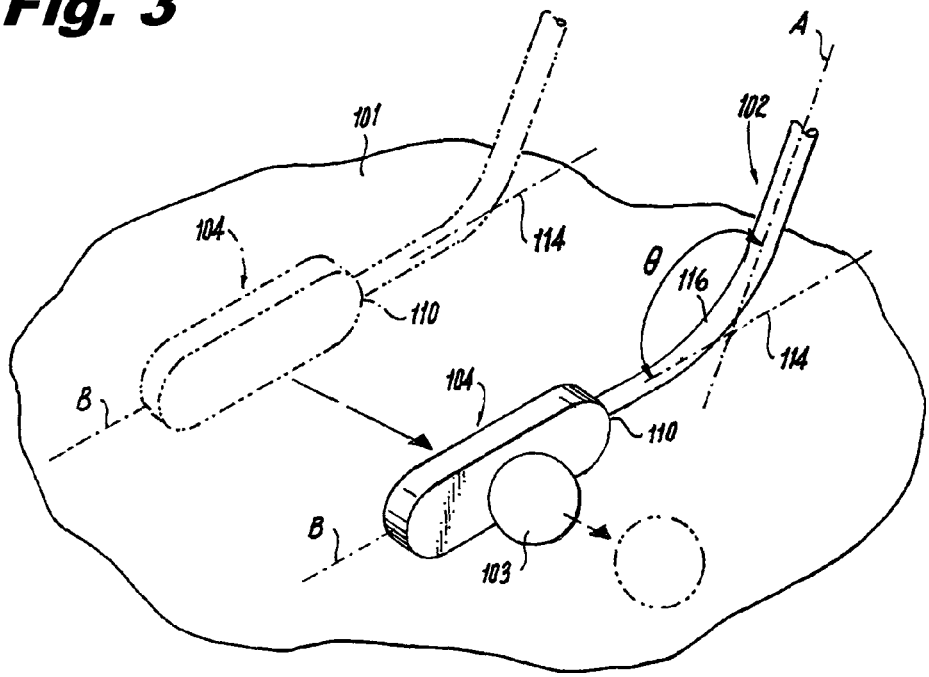
FIG. 3 is an enlarged perspective view of a distal end of the golf putter of FIG. 1, schematically indicating the substantially parallel motion of the club head with respect to the ground during a stroke.

Now with reference to FIG. 3, tangent 114 of distal end 110 is parallel to club head axis B and, in the rest position shown in FIG. 2, club head axis B is substantially parallel to ground surface 101. Therein, in the rest position, tangent 114 of distal end 110 is also substantially parallel to ground surface 101. Those skilled in the art will readily appreciate the parallel orientation between distal end 110 and ground surface 101 can permit a golfer to acquire a longer, more consistent putting stroke, parallel to ground surface 101, during the back-swing, down-swing, and through impact and follow-through, as shown by the arrows in FIG. 3. It is contemplated that the parallel orientation between distal end 110 and ground surface 101 can also reduce deceleration of club head 104 through the down-swing and through impact, and reduces instances of striking a ball 103 too far into the up-swing of the follow-through, also known as topping the ball. Those having skill in the art will also readily appreciate that the parallel orientation between distal end 110 and ground surface 101 tends to encourage the golfer to maintain a smooth putting stroke with arm muscles as opposed to hand or wrist muscles, therein reducing inconsistencies that can occur when the smaller muscle groups of the hands and wrists are used.

As shown in FIGS. 2 and 3, an angle θ between tangent 114 of distal end 110 and longitudinal axis A is greater than 90 degrees. Those skilled in the art will readily appreciate that angle θ can be a variety of suitable angles ranging from 90 to 160 degrees. For example, angle θ can have an exemplary range from 115 to 135 degrees. As a specific example, angle θ can be 125 degrees. Those skilled in the art will readily appreciate that angle θ can vary depending on the desired lateral distance, such as lateral distance C described above, between proximal end 108 and distal end 110.

Those skilled in the art will also readily appreciate that the methods and devices described above can also be applied or adapted to any other suitable putter club without departing from the spirit and scope of the invention. The devices, methods and systems of the present invention, as described above and shown in the drawings, provide for a golf putter club with superior properties including increased putting accuracy. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A golf putter comprising:

a club shaft body extending from a proximal end to a distal end, having a first linear portion defining a longitudinal axis and a curved portion between the first linear portion and the distal end, wherein the distal end defines a tangent to the curved portion angled with respect to the longitudinal axis; and a club head including a ball striking surface, a heel proximate to a first end of the ball striking surface, and a toe opposing the heel proximate to a second end of the ball striking surface, wherein a club head axis is defined between the toe and the heel, wherein the distal end of the club shaft body is fixedly connected to the club head with respect to the ball striking surface at a connection point on the heel, and wherein a distance between the connection point of the distal end on the heel to a point defined at the intersection of the tangent of the distal end and the longitudinal axis, in a direction parallel to the club head axis, ranges from 1 inch to 5 inches.

2. A golf putter as recited in claim 1, wherein the tangent of the distal end is parallel to the club head axis.

3. A golf putter as recited in claim 1, wherein a distance between the distal end to a point defined at the intersection of the club head axis and a line normal to the club head axis extending from the proximal end ranges from 8 inches to 18 inches.

4. A golf putter as recited in claim 1, wherein a distance between the distal end to a point defined at the intersection of the tangent of the distal end and a line normal to the tangent extending from the proximal end ranges from 8 inches to 18 inches.

5. A golf putter as recited in claim 1, wherein an angle between the tangent of the distal end and the longitudinal axis ranges from 90 degrees to 160 degrees.

6. A golf putter as recited in claim 1, wherein an angle between the tangent of the distal end and the longitudinal axis ranges from 115 degrees to 135 degrees.

7. A golf putter as recited in claim 1, wherein the club shaft body includes a second linear portion proximate the distal end, and wherein the second linear portion is parallel to the club head axis at the connection point and angled with respect to the longitudinal axis.

8. A golf putter as recited in claim 1, wherein the club shaft body includes a second linear portion proximate the distal end, wherein the second linear portion is at an angle with respect to the longitudinal axis, and wherein the angle between the second linear portion and the longitudinal axis ranges from 90 degrees to 160 degrees.

9. A golf putter as recited in claim 1, wherein the club shaft body includes a second linear portion proximate the distal end, wherein the second linear portion is at an angle with respect to the longitudinal axis, and wherein the angle between the second linear portion and the longitudinal axis ranges from 115 degrees to 135 degrees.

10. A golf putter as recited in claim 1, wherein the club head includes a bottom surface defined between the toe and the heel, wherein at least a portion of the bottom surface is configured to be parallel to a ground surface.

11. A golf putter as recited in claim 1, wherein the club head includes a receptacle proximate to the connection point for receiving the distal end of the club shaft body.

* * * * *